US007045700B2

(12) United States Patent
Hämäläinen et al.

(10) Patent No.: US 7,045,700 B2
(45) Date of Patent: May 16, 2006

(54) METHOD AND APPARATUS FOR PLAYING A DIGITAL MUSIC FILE BASED ON RESOURCE AVAILABILITY

(75) Inventors: Matti S. Hämäläinen, Lempääla (FI); Timo Kosonen, Tampere (FI)

(73) Assignee: Nokia Corporation, Espoo (FI)

( * ) Notice: Subject to any disclaimer, the term of this patent is extended or adjusted under 35 U.S.C. 154(b) by 182 days.

(21) Appl. No.: 10/826,704

(22) Filed: Apr. 16, 2004

(65) Prior Publication Data

US 2004/0267541 A1 Dec. 30, 2004

Related U.S. Application Data

(60) Provisional application No. 60/484,148, filed on Jun. 30, 2003.

(51) Int. Cl.
*G10H 7/00* (2006.01)

(52) U.S. Cl. ..... 84/645; 84/615; 84/618

(58) Field of Classification Search ..... 84/645, 84/615, 617, 622, 626; 434/307 A
See application file for complete search history.

(56) References Cited

U.S. PATENT DOCUMENTS 5,138,926 A * 8/1992 Stier et al. ..... 84/615
5,380,949 A * 1/1995 Matsuda ..... 84/618
6,806,412 B1 * 10/2004 Fay ..... 84/645
2004/0159219 A1 * 8/2004 Holm et al. ..... 84/645

OTHER PUBLICATIONS

Scalable Polyphony MIDI Specification, Version 1.0, Dec. 2001, RP-034. The MIDI Manufacturers Association, Los Angeles, CA, USA, 2002.
Mobile DLS Downloadable Sounds Level, Version 1.00. 22432, May 2003, including MOD LFO to gain changes, published by The MIDI Manufactures Association, Los Angeles, CA, USA, 2003.

* cited by examiner

*Primary Examiner*—David Martin
*Assistant Examiner*—Christina Russell
(74) *Attorney, Agent, or Firm*—Ware, Fressola, Van Der Sluys & Adolphson LLP

(57) ABSTRACT

A method and corresponding equipment by which a synthesizer/MIDI (musical instrument digital interface) device (10) is able to optimally perform a MIDI file (11) taking into account not the polyphony required by the MIDI file (11) as in SP-MIDI (scalable polyphony MIDI), but taking into account instead extended scalable polyphony (XSP) data 12*b* including the maximum number of instantaneous voices required by the MIDI file and the categories in which they occur for different channel masking, and also taking into account the architecture of the synthesizer/MIDI device (10) in terms of a voice complexity coefficient table (12*b*) indicating the relative complexity (corresponding to a resource requirement) for voices in each category. The result is a total voice requirement table 12*c*-1 indicating typically less masking than would be required for the same synthesizer/MIDI device to play the MIDI file according to SP-MIDI.

25 Claims, 4 Drawing Sheets

12a-1

| PRI | MIP | MIV | General MIDI | DLS3 | DLS2 | DLS1 | Sample | Undefined |
|---|---|---|---|---|---|---|---|---|
| 14 | 127 | 250 | 35 | 40 | 75 | 18 | 80 | 2 |
| 7 | 48 | 130 | 20 | 30 | 45 | 15 | 12 | 8 |
| 8 | 32 | 86 | 14 | 23 | 20 | 15 | 14 | 0 |
| 2 | 24 | 56 | 10 | 8 | 20 | 9 | 8 | 1 |
| 9 | 8 | 24 | 7 | 4 | 8 | 3 | 2 | 0 |
| 3 | 4 | 16 | 6 | 4 | 4 | 1 | 1 | 0 |
| 11 | 2 | 2 | 1 | 1 | 0 | 0 | 0 | 0 |
| 1 | 1 | 2 | 1 | 1 | 0 | 0 | 0 | 0 |

12b

| VCC | General MIDI | DLS3 | DLS2 | DLS1 | Sample | Undefined |
|---|---|---|---|---|---|---|
| | 1 | 1 | 0.8 | 0.4 | 0.3 | 1 |

12c-1

| Polyphony | General MIDI | DLS3 | DLS2 | DLS1 | Sample | Undefined | TVR (System 1) |
|---|---|---|---|---|---|---|---|
| 256 | 35 | 40 | 60 | 7.2 | 24 | 2 | **168.2** |
| 128 | 20 | 30 | 36 | 6 | 3.6 | 8 | **103.6** |
| 64 | 14 | 23 | 16 | 6 | 4.2 | 0 | **63.2** |
| 32 | 10 | 8 | 16 | 3.6 | 2.4 | 1 | **41** |
| 24 | 7 | 4 | 6.4 | 1.2 | 0.6 | 0 | **19.2** |
| 16 | 6 | 4 | 3.2 | 0.4 | 0.3 | 0 | **13.9** |
| 4 | 1 | 1 | 0 | 0 | 0 | 0 | **2** |
| | 1 | 1 | 0 | 0 | 0 | 0 | **2** |

| PRI | MIP | MIV | General MIDI | DLS3 | DLS2 | DLS1 | Sample | Undefined |
|---|---|---|---|---|---|---|---|---|
| 14 | 127 | 250 | 35 | 40 | 75 | 18 | 80 | 2 |
| 7 | 48 | 130 | 20 | 30 | 45 | 15 | 12 | 8 |
| 8 | 32 | 86 | 14 | 23 | 20 | 15 | 14 | 0 |
| 2 | 24 | 56 | 10 | 8 | 20 | 9 | 8 | 1 |
| 9 | 8 | 24 | 7 | 4 | 8 | 3 | 2 | 0 |
| 3 | 4 | 16 | 6 | 4 | 4 | 1 | 1 | 0 |
| 11 | 2 | 2 | 1 | 1 | 0 | 0 | 0 | 0 |
| 1 | 1 | 2 | 1 | 1 | 0 | 0 | 0 | 0 |

12b'

| | General MIDI | DLS3 | DLS2 | DLS1 | Sample | Undefined |
|---|---|---|---|---|---|---|
| VCC | 1 | 1 | 1 | 1 | 1 | 1 |

| Polyphony | General MIDI | DLS3 | DLS2 | DLS1 | Sample | Undefined | TVR (System 2) |
|---|---|---|---|---|---|---|---|
| 256 | 35 | 40 | 75 | 18 | 80 | 2 | **250** |
| 128 | 20 | 30 | 45 | 15 | 12 | 8 | **130** |
| 64 | 14 | 23 | 20 | 15 | 14 | 0 | **86** |
| 32 | 10 | 8 | 20 | 9 | 8 | 1 | **56** |
| 24 | 7 | 4 | 8 | 3 | 2 | 0 | **24** |
| 16 | 6 | 4 | 4 | 1 | 1 | 0 | **16** |
| 4 | 1 | 1 | 0 | 0 | 0 | 0 | **2** |
| | 1 | 1 | 0 | 0 | 0 | 0 | **2** |

FIG. 3

| PRI | MIP | MIV | TVR (System 1) | TVR (System 2) | Reduction | Polyphony |
|---|---|---|---|---|---|---|
| 14 | 127 | 250 | **168.2** | **250** | 32.7% | 256 |
| 7 | 48 | 130 | **103.6** | **130** | 20.3% | 128 |
| 8 | 32 | 86 | **63.2** | **86** | 26.5% | 64 |
| 2 | 24 | 56 | **41** | **56** | 26.8% | 32 |
| 9 | 8 | 24 | **19.2** | **24** | 20.0% | 24 |
| 3 | 4 | 16 | **13.9** | **16** | 13.1% | 16 |
| 11 | 2 | 2 | **2** | **2** | 0.0% | 4 |
| 1 | 1 | 2 | **2** | **2** | 0.0% | |

FIG. 4

METHOD AND APPARATUS FOR PLAYING A DIGITAL MUSIC FILE BASED ON RESOURCE AVAILABILITY

CROSS REFERENCE TO RELATED APPLICATION

Reference is made to and priority claimed from U.S. provisional application Ser. No. 60/484,148, filed Jun. 30, 2003, entitled METHOD AND APPARATUS FOR PLAYING A DIGITAL MUSIC FILE BASED ON RESOURCE AVAILABILITY.

TECHNICAL FIELD

The present invention pertains to the field of musical instrument digital interface (MIDI) compatible devices, which produce music based on the content of instructions included in MIDI files, and also synthetic audio systems, which produce music based on the content of instructions included in other kinds of music files or music container files. More particularly, the present invention pertains to determining how to provide music corresponding to a music file in case of a music-producing device having fewer than the full resources (including e.g. microprocessor instruction processing resources) needed to provide all channels of the corresponding music, even in case of resources that change in the course of providing the corresponding music.

BACKGROUND ART

The terminology used here in regard to MIDI technology and to audio systems in general is as follows:

voice: a note played by a sound module including not only the synthesized voice provided by a sound generator, but also the voice produced by a digital audio effect. In other words, the term "voice" as used here includes a synthesized voice and an audio effect voice.

synthesizer application: a player and a sound module.

synthesizer: the building block/component of a synthesizer application that generates actual sound, i.e. a sound module, i.e. a musical instrument that produces sound by the use of electronic circuitry.

sequencer application: a sequencer and associated equipment.

sequencer: the building block/component of a sequencer application that plays or records information about sound, i.e. information used to produce sound; in MIDI, it is a device that plays or records MIDI events.

player: equipment that includes a sequencer.

sound generator: an oscillator, i.e. an algorithm or a circuit of a synthesizer that creates sound corresponding to a particular note, and so (since it is actual sound) having a particular timbre.

sound module: a synthesizer; contains sound generators and audio processing means for the generation of digital audio effects.

digital audio effect: audio signal processing effect used for changing the sound characteristics, i.e. mainly the timbre of the sound.

note: musical event/instruction that is used to represent musical score, control sound generation and digital audio effects. In other words, the term "note" as used here includes a musical score event, events for controlling the sound generator, and digital audio effects.

A standard MIDI (musical instrument digital interface) file (SMF) describes a musical composition (or, more generally, a succession of sounds) as a MIDI data sequence, i.e. it is in essence a data sequence providing a musical score. It is input to either a synthesizer application (in which case music corresponding to the MIDI file is produced in real time, i.e. the synthesizer application produces playback according to the MIDI file) or a sequencer application (in which case the data sequence can be captured, stored, edited, combined and replayed).

A MIDI player provides the data stream corresponding to a MIDI file to a sound module containing one or more note generators. A MIDI file provides instructions for producing sound for different channels, and each channel is mapped or assigned to one instrument. The sound module can produce the sound of a single voice or a sound having a single timbre (i.e. e.g. a particular kind of conventional instrument such as a violin or a trumpet, or a wholly imaginary instrument) or can produce the sound of several different voices or timbres at the same time (e.g. to the sound made by two different people singing the same notes at the same time, or a violin and a trumpet playing the same notes at the same time, or an electronic piano instrument that is commonly implemented using two layered voices that are slightly de-tuned, producing desired aesthetic tone modulation effects).

The terminology in connection with MIDI technology is such that a "note" is, or corresponds to, a "sound," which may be produced by one or more "voices" each having a unique (and different) "timbre" (which is e.g. what sets apart the different sounds of middle C played on different instruments, appropriately transposed). Notes in a MIDI file are indicated by predetermined numbers, and different notes in a MIDI file for other than percussion instruments correspond to different musical notes, whereas for different notes for percussion correspond to (the one and only sound played by respective) different percussion instruments (bass drum vs. cymbal vs. bongo, and so on). A MIDI file can specify that at a particular point in time, instead of just one note (monophonic) of one particular timbre (monotimbral) being played (i.e. of one particular voice, such as e.g. the "voice" of a violin), several different notes (polyphonic) are to be played, each possibly using a different timbre (multitimbral).

The prior art teaches what is here called standard scalable polyphony MIDI (SP-MIDI), i.e. the prior art teaches providing with a MIDI file additional instructions as to how to interpret the MIDI file differently, depending on the capabilities of the MIDI compatible device (sequencer and sound modules). In essence, static SP-MIDI instructions—provided in the MIDI file—convey to a MIDI device the order in which channels are to be muted, or in other words masked, in case the MIDI device is not capable of creating all of the sounds indicated by the MIDI file. Thus, e.g. standard SP-MIDI instructions might convey that the corresponding MIDI file indicates at most nine channels and uses at most the polyphony of 20 notes at any time, but that if a certain channel number (the lowest priority) is dropped—say channel number three—leaving only eight channels, then the number of notes required drops to sixteen. Thus, if the MIDI device has the capability of producing only sixteen notes (of possibly different timbres), it would drop channel number three (patched e.g. to a saxophone sound), and so, in the estimation of the composer/creator of the MIDI file, would sound as good as possible on the limited-polyphony MIDI device.

To produce sound corresponding to a MIDI file requires resources, including e.g. oscillators for providing the sound module functionality and also resources equipment providing the sequencer functionality. The synthesizer and sequencer functionality is often provided by a general purpose microprocessor used to run all sorts of different applications, i.e. a programmable software MIDI synthesizer is used. For example, a mobile phone may be playing music according to a MIDI file and at the same time creating screens corresponding to different web pages being accessed over the Internet. In such a case the resources include computing resources (CPU processing and memory, e.g.), and the resources available for providing the synthesizer or sequencer functionality vary, and sometimes can drop to such a level that the mobile phone cannot, at least temporarily, perform the MIDI file "score" in the same way as before the decrease in available computing resources. As explained above, standard SP-MIDI allows for muting channels, but more importantly in case of resources that change in time, standard SP-MIDI helps by enabling the MIDI device to decrease in real-time the computing resources it needs by muting/masking predetermined channels; to adjust to changed resource availability, the MIDI device just calculates its channel masking again based on the new available resources. The composer can control the corresponding musical changes using the prioritization of MIDI channels and careful preparation of the scalable musical arrangement. Standard SP-MIDI content may even contain multiple so-called maximum instantaneous polyphony (MIP) messages anywhere in a MIDI file, in addition to (a required) such message at the beginning of the file, thus enabling indicating different muting strategies for different segments of a MIDI file.

While standard SP-MIDI does provide functionality in the time domain, it does not provide similar or corresponding functionality in respect to voice complexity. Standard SP-MIDI does not contain information about voices, only notes. With standard SP-MIDI, the synthesizer manufacturer must make sure that there are enough voices available for the required polyphony (number of notes simultaneously). For example, if any note uses two voices, according to standard SP-MIDI, there needs to be 40 voices available if the polyphony required by the content is 20; in other words, the synthesizer manufacturer must prepare for the worst case consumption of the voices in case of having only standard SP-MIDI available to composers to cope with different synthesizer capabilities.

Thus, what is needed is a more precise way of altering how a MIDI file is played on different MIDI devices with different capabilities, and ideally a more refined way of adapting to changes in resources available to a MIDI device while it is playing a MIDI file.

DISCLOSURE OF THE INVENTION

Accordingly, in a first aspect of the invention, a method is provided by which a programmable device, used for producing music based on a digital music file indicating instructions for producing music on different channels, determines which if any channels to mute depending on available resources, the method characterized by: a step, responsive to channel masking data associated with the digital music file and indicating at least one channel masking in different categories for at least one channel, of providing for each category of the channel a complexity-adjusted number of voices based on a relative resource consumption required by the programmable device when producing voices in the category; and a step, responsive to the complexity-adjusted numbers of voices for respective categories for the channel masking, of providing a total voice requirement corresponding to the channel masking.

In accord with the first aspect of the invention, the channel masking data may indicate masking of at least one channel in terms of a number of voices required to play the music for the channel and partitioned among different categories of music requiring possibly different resources.

Also in accord with the first aspect of the invention, each complexity-adjusted number of voices may be adjusted for complexity by a voice complexity coefficient for the respective category, the complexity coefficients indicating a relative resource consumption required by the programmable device when producing voices in each category.

Also in accord with the first aspect of the invention, the categories may include a general MIDI category, a Downloadable Sounds level 2 (DLS2) category, a Downloadable Sounds level 1 (DLS1) category, and a sample category for providing audio processing effects, which may include one or more effects indicated by reverb, chorus, flanger, phaser, parametric equalizer, graphical equalizer, or sound according to a three-dimensional sound processing algorithm.

Also in accord with the first aspect of the invention, the method may further be characterized by: a step, responsive to the total voice requirement, of assessing resources available and selecting channel masking to use in playing the digital music file.

In a second aspect of the invention, a method is provided for playing a digital music file with instructions for producing music arranged on a plurality of channels, wherein the digital music file includes information about resources required for playing music corresponding to the digital music file and is played by a digital music player with predetermined processing capabilities, the method comprising: organizing the digital music file so that the channels are ranked according to musical importance and assigned a corresponding channel priority; providing a digital music player having a processing requirement calculation means for calculating the device specific consumption of processing resources based on processing complexity information stored in the device; and having the digital music player play the music use a playback control adjusting means for selecting the playback resources not exceeding the available processing resources of the digital music player, as controlled by the processing requirement calculation means; the method characterized in that: the digital music file information is classified into at least one predefined voice category corresponding to a digital music player voice architecture configuration such that the digital music player calculates the processing requirements based on the information in the digital music file and the processing complexity information so as to predict the processing requirements for different voice resources prior to the playback of the digital music file.

In accord with the second aspect of the invention, depending on the embodiment, the playback resource requirement information may contain voice classification information, which may define DLS voice configurations and audio processing effects such as effects indicated by reverb, chorus, flanger, phaser, parametric equalizer, graphical equalizer, or a three-dimensional sound processing algorithm. Also, the playback resource requirement information may contain MIV information. Also the processing complexity information may be a voice complexity coefficient. Also, the digital music player voice architecture configuration may be a DLS1 voice architecture or a DLS2 voice architecture. Also, the digital music player may be a MIDI synthesizer, and the digital music file may be an XMF file. Also still, the playback control adjusting means may use channel masking for adjusting the processing load. Also still, a playback resource adjustment decision may be made prior to the playback of the digital music file. Also still, the digital music player voice architecture configuration may be such as to be adjustable during the playback, i.e. dynamically. Still also, the digital music player voice architecture may be such as to represent multiple different voice configurations in parallel for the playback of one digital music file.

In a third aspect of the invention, a method is provided for playing a digital music file with instructions for producing music arranged on a plurality of channels, wherein the digital music file includes information about resources required for playing music corresponding to the digital music file and is played by a digital music player with predetermined processing capabilities, the method comprising: organizing the digital music file so that the channels are ranked according to musical importance and assigned a corresponding channel priority; providing a digital music player having a processing requirement calculation means for calculating the device specific consumption of processing resources based on processing complexity information stored in the device; and having the digital music player play the music use a playback control adjusting means for selecting the playback resources of the device controlled by processing requirement calculation means; the method characterized in that: the digital music file information contains playback resource requirement information classified into at least one category corresponding to a digital music player configuration with known processing requirements, and device specific information is utilized by the processing requirement calculation means to ensure that the digital music player is able to play the music corresponding to the digital music file without exceeding the available resources.

In a fourth aspect of the invention, a method is provided for playing a digital music file with instructions for producing music arranged on a plurality of channels, wherein the digital music file includes information about resources required for playing music corresponding to the digital music file and is played by a digital music player with predetermined processing capabilities, the method comprising: organizing the digital music file so that the channels are ranked according to musical importance and assigned a corresponding channel priority; providing a digital music player having a processing requirement calculation means for calculating the device specific consumption of processing resources based on processing complexity information stored in the device; and having the digital music player play the music use a playback control adjusting means for selecting the playback resources not exceeding the available processing resources of the digital music player, as controlled by the processing requirement calculation means; the method characterized in that: the digital music player supports device resource management for multiple processing configurations by calculating the total processing requirements based on content dependent processing requirement information and device specific processing complexity information.

In a fifth aspect of the invention, an apparatus is provided, of use in producing music based on a digital music file indicating instructions for producing music on different channels, the apparatus including means for determining which if any channels to mute depending on resources available to the apparatus, the apparatus characterized by: means, responsive to channel masking data associated with the digital music file and possibly indicating masking of at least one channel in terms of a number of voices required to play the music for the channel and partitioned among different categories of music requiring possibly different resources, for providing a complexity-adjusted number of voices for each category indicated by the channel masking data for each channel, each complexity-adjusted number of voices adjusted for complexity based on relative resource consumption required by the programmable device when producing voices in each category; and means, responsive to the complexity-adjusted numbers of voices for respective categories for each channel masking, for providing a total voice requirement corresponding to each channel masking.

In accord with the fifth aspect of the invention, the categories may include a general MIDI category, a DLS2 category, and a DLS1 category.

Also in accord with the fifth aspect of the invention, the apparatus may be further characterized by: means, responsive to the total voice requirement, for assessing resources available and selecting channel masking to use in playing the digital music file.

BRIEF DESCRIPTION OF THE DRAWINGS

The above and other objects, features and advantages of the invention will become apparent from a consideration of the subsequent detailed description presented in connection with accompanying drawings, in which:

FIG. 3 is a schematic representation of voice information used by and computed by a synthesizer/MIDI device operative according to the invention, and in particular such information in case of a synthesizer/MIDI device not having a dynamic voice architecture.

FIG. 4 is a comparison of the use of resources—as indicated by the number of voices two different synthesizers/MIDI devices must be able to produce, called here a total voice requirement, to play music in a music file according to different indicated priorities—by a synthesizer/MIDI device having the voice information indicated in FIG. 2 (illustrating operation in case of a dynamic voice architecture) and a synthesizer/MIDI device having the voice information indicated in FIG. 3 (indicating a voice architecture using the same resources for all kinds of voices).

BEST MODE FOR CARRYING OUT THE INVENTION

To alter how a MIDI file is played and more generally to alter how a synthetic audio device plays music described by a file (as opposed to recorded in a file, as in case of an ordinary analog or digital recording of a performance), the invention uses Maximum Instantaneous (number of) Voices (MIV) values provided by the composer of the MIDI file, so optimization is possible in respect to the required number of voices, as opposed to with respect to the maximum instantaneous number of notes—i.e. the so-called Maximum Instantaneous Polyphony (MIP)—in the case of standard SP-MIDI, which overreacts to fewer resources (both dynamic, such as CPU utilization by the device and memory, and also static, such as the number of oscillators included in the device) in that it provides for worst case consumption of resources. Thus, the invention provides what might be called scalable voices, as opposed to scalable polyphony. Instead of basing performance (i.e. channel masking) on the required number of notes (i.e. on the MIP), what the invention does is to have the composer provide not only the MIP values for different channel masking, but also the required number of voices and a partitioning of the voices among different categories of resource consumption; in addition, it uses information provided by the synthesizer/MIDI device (i.e. any synthetic audio device) manufacturer indicating relative levels of resource consumption. The end result is a total (effective) voice requirement figure that the synthesizer/MIDI device can use to adjust how it plays the MIDI file based on its (possibly changing) resources.

Figures 1, 2:
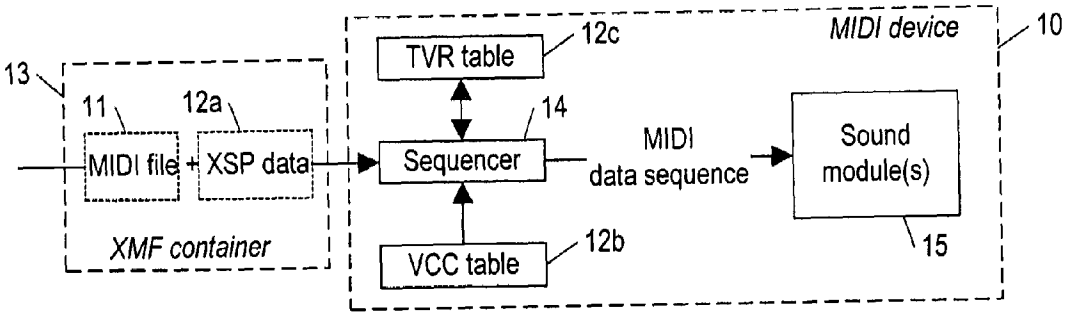
FIG. 1 is a block diagram/flow diagram of synthesizer/MIDI device operative according to the invention, and so receiving not only a music file (such as a MIDI file) but also voice data for use in determining how best to play the music described by the music file depending on resource availability.
FIG. 2 is a schematic representation of voice information used by and computed by a synthesizer/MIDI device operative according to the invention, and in particular such information in case of a synthesizer/MIDI device having a dynamic voice architecture, i.e. one that uses less resources to play simpler voices.

Referring now to FIG. 1 and FIG. 2, according to the invention, a composer/creator of a MIDI file 11 (or more generally, a digital music file) provides, as e.g. an additional data in an XMF container 13 (or as part of the MIDI file or in an XMF file or in any other similar container) so as to be associated with the MIDI file 11, XSP (extended scalable polyphony) data 12*a* (as a single XSP table 12*a*-1 or as a sequence of tables corresponding to different points in the playing of the associated MIDI file) conveying information able to be used by a MIDI device 10 (or more generally, a programmable device, programmed for playing the MIDI file or other kind of digital music file) executing an algorithm according to the invention in determining how to perform the MIDI file differently depending on the number of voices able to be generated by the MIDI device (which may change even while the MIDI file is being played/performed). The result of the calculation is a table 12*c*-1 to which the MIDI device can refer periodically during a performance of the MIDI file as the resources available for performing the MIDI file change, resources including not only fixed resources such as oscillators (of sound modules) but also variable resources such as computing resources (varying because of varying loads imposed by other applications) and so to provide at any moment of time during the performance as good a performance as possible (according to the estimation of the composer/creator of the MIDI file) given the available resources.

In case of a series of XSP tables 12*a*-1 corresponding to different points in the playing of the MIDI file, the above-described TVR calculation is made in the beginning of the playback and then another calculation is made at each point in the MIDI file for which there is a new corresponding XSP table 12*a*-1. All the calculations may update the same TVR table 12*c*-1. In a typical implementation, there may not be an actual TVR table 12*c*-1, and the use of the TVR table 12*c*-1 here can be considered as illustrative only for such embodiments, where the code executing the TVR algorithm provided by the invention takes care of channel masking without referring to any tables and instead using temporary values created during execution of the code.

Each XSP table 12*a*-1 provided by the composer indicates a sequence of MIV values and corresponding classification values, with each table (if there is more than one) indicating a point in the associated MIDI file to which the XSP table 12*a*-1 applies. If there are multiple XSP tables 12*a*-1 of MIV values and classification values in the content pointing to different moments of time in the MIDI stream, the device needs to recalculate channel masking (as described below) whenever it starts to use new MIV values or classification values.

The calculated (or recalculated) channel masking is provided as a total voice requirement (TVR) table 12*c*-1 (FIG. 2) corresponding to a particular XSP table 12*a*-1, and as explained below in more detail, is derived from the XSP table(s) 12*a*-1 but accounts for complexity in providing the different voices called for by the MIDI file, complexity that is associated with or specific to the particular synthesizer/MIDI device and so would typically be provided by the manufacturer. The complexity information is conveyed by a voice complexity coefficient (VCC) table 12*b*.

According to the invention, a synthesizer/MIDI device makes a decision about resource allocation based on the TVR information (i.e. based on the TVR table 12*c*-1 or some embodiment of the information in such a table), which accounts for voice complexity, not merely the XSP information (regarding the MIV requirement) provided by the (one or more) XSP table(s) 12*a*-1, allowing the synthesizer/MIDI device to play more voices than would be possible using only the MIV requirement (i.e. and so not accounting for complexity in providing different kinds of voices, complexity that is associated with the architecture of the synthesizer/MIDI device). Ignoring the complexity information would result in a total voice requirement based on assuming that all different kinds of voices (i.e. for all different classifications, explained more below) require the same resources, and so would cause the synthesizer/MIDI device to play the MIDI file less than optimally (given the resources available). But it is in general not true that voices in different categories require the same resources; it depends on the particular synthesizer/MIDI device. If a synthesizer engine supports (dynamically or statically) different complexity voices, then the fact that some categories of voices require fewer resources can be taken into account, allowing the synthesizer/MIDI device to play more voices.

Still referring to FIG. 1, in a typical embodiment of the invention, the MIDI device 10—or in general, a device for providing music based on a digital music file—includes a software sequencer 14 (i.e. software executing on a general purpose microprocessor used to run all sorts of applications) that executes the algorithm provided by the invention using as input the XSP data 12*a* and the VCC table 12*b* included with the MIDI device 10, producing the TVR table 12*c* (although the invention does not necessarily actually ever produce or utilize a table per se), which is then referred to periodically to provide to one or more sound modules 15*a* (scalable voice) MIDI data sequence corresponding to the MIDI file 11. The algorithm is re-run each time the available resources change or the MIV values being used or the classification values change.

Referring now to FIG. 2, the XSP data 12*a* is indicated as including at least one XSP table 12*a*-1 which provides, for each of various channel priority (PRI) values indicating channels in the order in which the channels are to be muted so as to meet resource availabilities, a corresponding (optional) MIP value (not necessary to the invention), a corresponding MIV value, and a corresponding allocation or classification of the voices as belonging to one or another of various different categories, including e.g.: general MIDI (i.e. voices according to the general MIDI standard), DLS3 (hypothetical future instrument standard used as an example), DLS2, DLS1, sample, and undefined (i.e. any other category, the undefined category value can be calculated by subtracting the values for the other categories from the corresponding MIV value). Preferably, the different categories include at least general MIDI, DLS2 and DLS1. The first row, indicating in this case a PRI value of 14, indicates that to play channel 14 as well as the channels indicated in all of the other rows, the synthesizer/MIDI device must have the resources to produce (at least at one point in time while playing the MIDI file) 127 notes as 250 different voices. The next row, with a PRI value of 7, indicates that to play all channels except that indicated in the top row requires (at least at one point in the MIDI file) the resources to produce 48 notes as 130 voices, and so on.

Still referring to FIG. 2, the VCC table 12*b*, provided by the manufacturer (or other source) and specific to the type of MIDI device 10, is shown as indicating a voice complexity coefficient for each of the categories of the XSP table 12*a*. There can be more than one VCC table 12*b* for a device; for example, for a device having more than one mode of operation, each mode of operation can have a possibly different VCC table.

Still referring to FIG. 2, the TVR table 12*c* is shown as providing a calculated total voice requirement value (rightmost column) for each of the various PRI values of the XSP table(s) 12*a*-1. The TVR for a given PRI value in a given XSP table 12*a*-1 is calculated by forming the sum of the products, for each category, of the voice complexity coefficient for the category from the VCC table 12*b* and the number of voices for the category shown in the XSP table 12*a*-1. Thus, for the PRI value indicating channel 14 (top row), the general MIDI voices (35) is multiplied by the corresponding voice complexity coefficient (1) yielding an (effective) number of voices of 35, . . . , the DLS1 category number of voices (18) is multiplied by the corresponding voice complexity coefficient (0.4) yielding an (effective) number of voices of 7.2, and so on, and all of these products are summed to produce a total (effective) number of required voices (i.e. a TVR value) of 168.2. The calculation of the TVR table 12*c*-1 is illustrated as pseudocode in the appendix.

The top row of the TVR table 12*c*-1 for which the calculated TVR is 168.2 indicates that the MIDI file at no point ever requires more than 168.2 (effective) voices, including all the voices on all channels, including channel 14. If the synthesizer/MIDI device does not have the resources required to provide the 168.2 (effective) voices, then (at least) channel 14 is masked (and others may be masked, depending on what resources are available, and depending on the TVR for the other PRI values).

Figure 7:
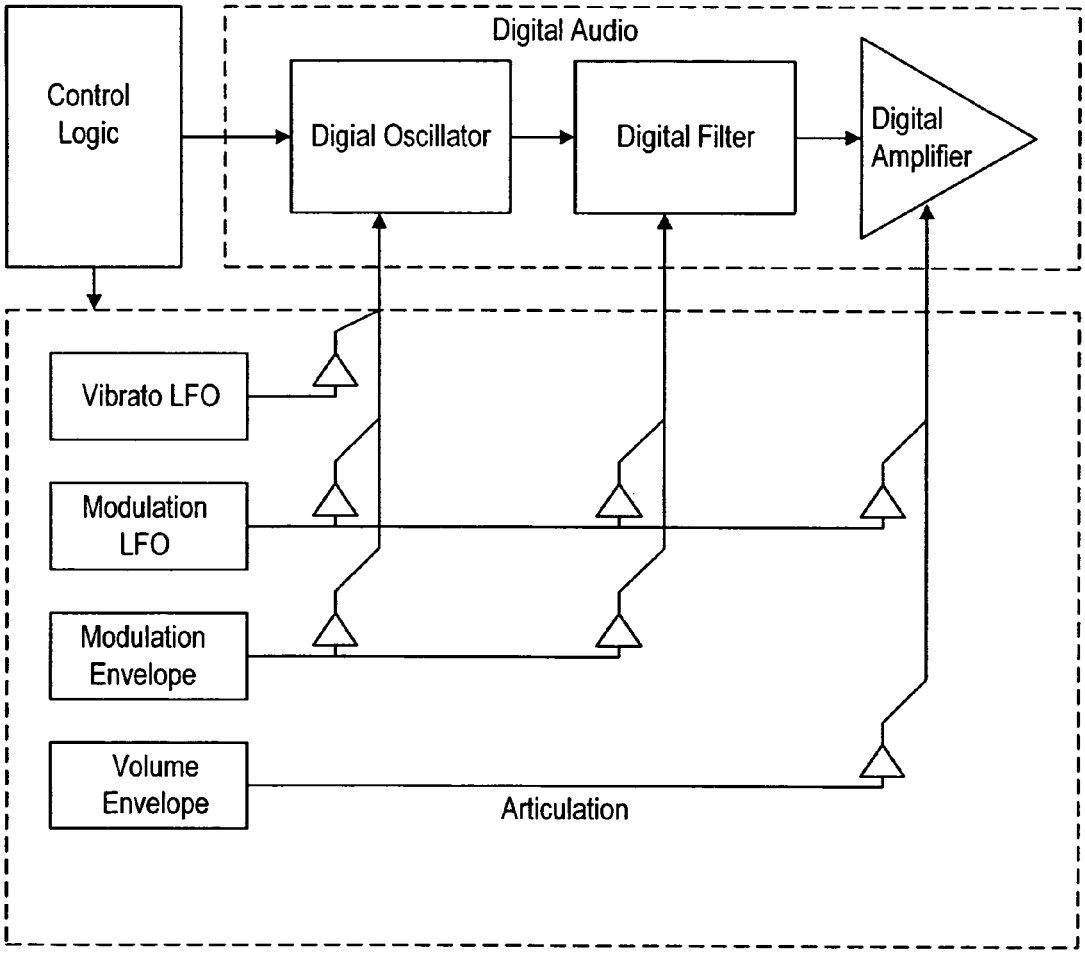
FIG. 7 (Prior Art)
FIG. 7 is a schematic representation of a synthesizer/MIDI device having a standard DLS2 voice architecture, an architecture that can in principle be adapted to provide dynamic voice architecture, in which case the synthesizer/MIDI device could have voice information similar to or the same as indicated in FIG. 2.

Referring now to FIG. 7, a software synthesizer is shown have a standard DLS2 architecture. Such a software synthesizer is capable of playing DLS1 instruments, but that does so using the resources (and so imposes the same processing load) as when playing DLS2 instruments. However, such a synthesizer/MIDI device could be fitted with functionality to adjust the resources it uses in playing simpler voices, and thus to have dynamic voice architecture, i.e. an architecture that provides a lower processing load for simpler voices (possibly DLS1 or sample) compared to more complex voices (possibly general MIDI or DLS3). If the synthesizer of FIG. 7 were fitted with dynamic voice architecture functionality, then it could have a VCC table such as shown in FIG. 2.

FIG. 3 shows a representation of voice information used by and computed by a synthesizer/MIDI device operative according to the invention, and in particular such information in case of a synthesizer/MIDI device not having a dynamic voice architecture.

Referring now to FIG. 4, a comparison is shown of the masking required by SP-MIDI or, equivalently, the invention in case of constant complexity voices, and the masking required in case of being able to take into account different complexity for different voices. FIG. 4 compares the use of resources—as indicated by the number of voices two different synthesizers/MIDI devices must be able to produce, called here a total voice requirement, to play music in a music file according to different indicated priorities—by a synthesizer/MIDI device having the voice information indicated in FIG. 2 (illustrating operation in case of a dynamic voice architecture) and a synthesizer/MIDI device having the voice information indicated in FIG. 3 (indicating a voice architecture using the same resources for all kinds of voices).

Figure 5:
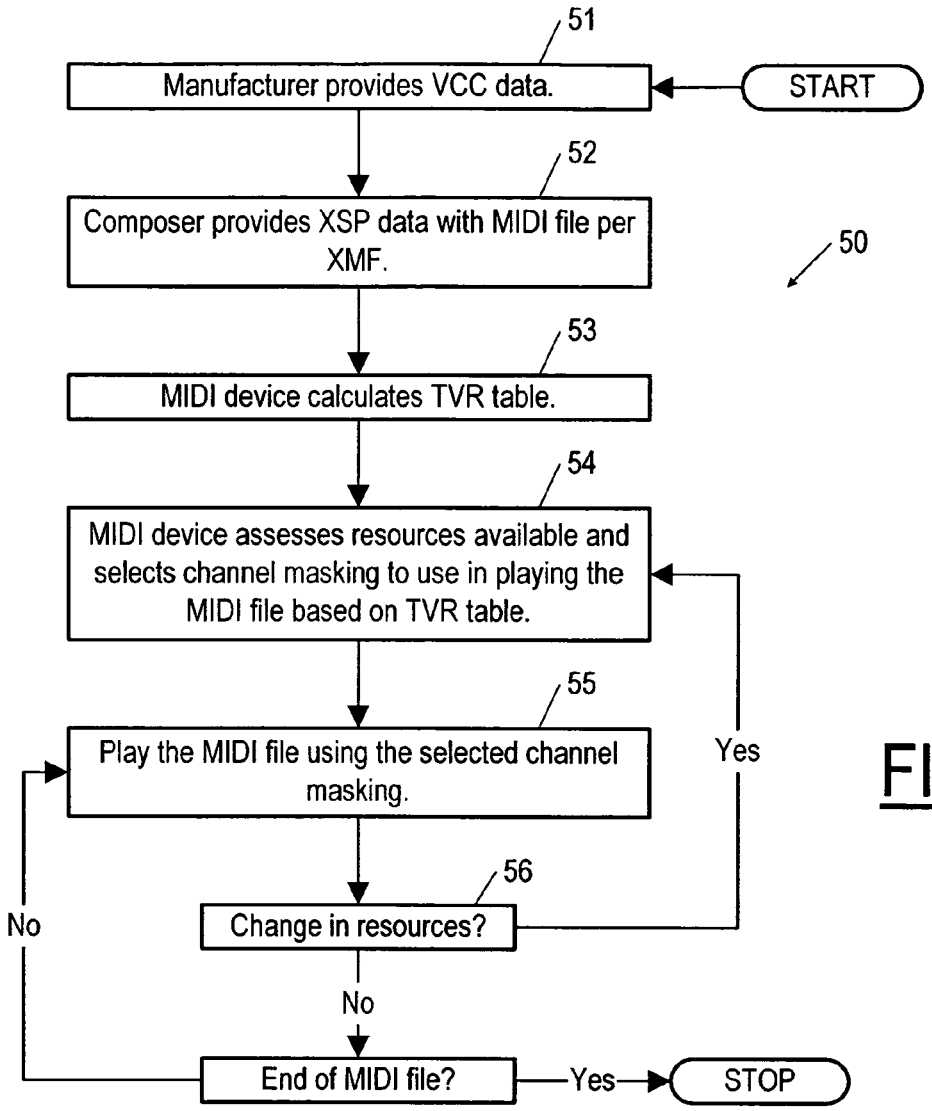
FIG. 5 is a flow diagram of the overall operation of a synthesizer/MIDI device according to the invention.

Referring now to FIG. 5 and also to FIGS. 1 and 2, a method 50 according to the invention is illustrated showing how to provide what is here called scalable voices for playing music based on a MIDI file or other similar kind of file providing information describing how to play a piece of music. The method 50 is shown in the context of a particular MIDI device playing music based on a MIDI file. According to the method 50, in a first step 51, the manufacturer (or some other appropriate entity) provides voice coefficient complexity coefficients for the MIDI device 10 (based on the type of device), i.e. provides the VCC data table 12*b*. In a next step 52, the composer provides XSP data 12*a* with the MIDI file 11 (per e.g. XMF). In a next step 53, the MIDI device calculates the TVR table 12*c*-1 as described above and as summarized below in respect to FIG. 6. In a next step 54, the MIDI device 10 assesses resources available and selects channel masking to use in playing the MIDI file 11 based on the TVR table 12*c*-1. In a next step 55, the MIDI device plays the MIDI file using the selected channel masking. In a next step 56, and periodically until the end of the MIDI file 11 is reached, the MIDI device 10 checks to determine if there has been a change in resources available to it (by e.g. checking on processor utilization using utilities provided with the operating system for the processor hosting the MIDI software). If so, then the MIDI device 10 repeats the step 54 of assessing the resources available and selects channel masking to use in playing the MIDI file 11 based on TVR table 12*c*-1.

Figure 6:
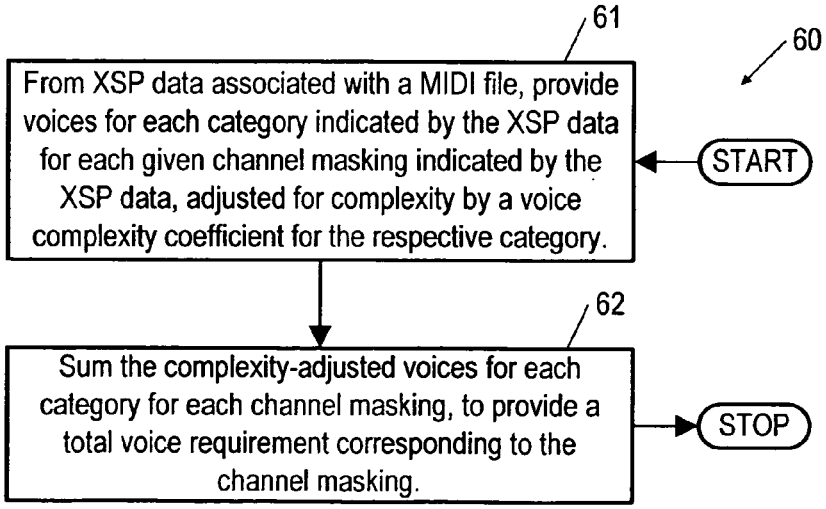
FIG. 6 is a flow diagram of the operation of a synthesizer/MIDI device when calculating a total voice requirement according to the invention.

Referring now to FIG. 6, a method 60 according to the invention and according to which the MIDI device 10—or, in general, any artificial synthesizer—performs the above described step 53 of calculating TVR table 12*c*-1, includes a first step 61 in which, in response to channel masking data, i.e. the XSP data 12*a* (provided as one or more XSP tables 12*a*-1), associated with the digital music file and indicating masking of at least one channel in terms of a number of voices required to play the music for the channel and partitioned among different categories of music requiring possibly different resources, the MIDI device provides, as e.g. in a table 12*c*-1, voices for each category indicated by the XSP data 12*a* for each given channel masking indicated by the XSP data 12*a*, adjusted for complexity by a voice complexity coefficient for the respective category. In a next step 62, the MIDI device sums the complexity-adjusted voices for each category for each channel masking, to provide a total voice requirement corresponding to the channel masking (as indicated in the table 12*c*-1).

As defined above, the term "voice" as used here and throughout the description includes generally not only a voice provided as a synthesizer/MIDI voice, but also a voice including post-processing effects. In other words, the term "voice" as used here includes a synthesized voice and a post-processed voice, i.e. an audio effect voice. The complexity calculation described above is the same for synthesized voices and for post-processed voices. It is also clear to someone skilled in art, that the voice categories can be structured to represent separate parts of synthesizer architecture (voice production chain) similarly to the case of separating the synthesizer voice and the post-processing voice. Individual parts of the voice architecture can also be classified similarly to standard DLS1 or DLS2 voices. The present invention is not limited by the voice architecture of the classification scheme used for possible partitioning the voice architecture into separate controllable configurations or possible dependencies between different configurations. Thus, partitioning of the voice architecture into multiple subparts is encompassed by the invention. We could have e.g. two classifications—DLS2-VoiceWithoutFilter and DLS2-Filter—and irrespective of the fact that DLS2-Filter might be completely useless as such without the DLS2VoiceWithoutFilter part of the voice, it is still encompassed by the invention. The idea here is that the synthesizer might have several separate parts like effects that could either be used or not used as a part of the voice generation. The presence and the CPU load of these additions could be easily presented using the voice classification scheme of the invention. Such a use case could be the usage of decompression codecs for unpacking waveform data before playback. Conceptually decompression codecs for unpacking waveform data could be considered a part of the voice architecture but all voices would not necessarily use the compression support.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

APPENDIX

Algorithm for the calculation of the total voice requirements based on MIV and corresponding classification data provided with a MIDI file. The code block for mip_length !=miv_length allows backward compatibility with SP-MIDI; if MIV data is not provided with the MIDI file, then the algorithm mutes channels exactly as in SP-MIDI.

Inputs

| | |
|---|---|
| polyphony: | The maximum number of Notes the player can play simultaneously |
| max_capacity: | The maximum processing capacity of voices |
| mip_length: | The number of entries in the MIP table |
| miv_length: | The number of entries in the MIV table |
| cla_width: | The number of architectures in the cla matrix |
| mip[ ]: | A vector filled with MIP values |
| miv[ ]: | A vector filled with MIV values |

-continued

| | |
|---|---|
| cla[,]: | A matrix of the MIV value classifications for different architectures |
| cla_name[ ]: | A vector of the names of the architecture classifications in the cla[,] matrix (cla_name [0] is used for unclassified voices). |
| pri [ ]: | A vector of the MIDI Channel numbers in priority order |
| n_ch: | Number of MIDI channels (16 for MIDI 1.0) |

Outputs

| | |
|---|---|
| mute [ ]: | A vector of 16 Boolean values specifying whether to mute the corresponding MIDI Channel |

Functions

| | |
|---|---|
| Vcc(cla) | Returns the complexity coefficient corresponding to the voice class |

Temporary variables

| | |
|---|---|
| i: | index variable |
| j: | index variable |
| ch: | Channel number |
| vo: | voice counter |
| to: | total voice requirement |

```
for i := 1 to n_ch do
    mute [i] := TRUE
end for
if mip_length != miv_length then
    for i := 1 to mip_length do
        ch := pri [i]
        if mip [i] <= polyphony then
            mutet[ch] := FALSE
        end if
    end for
else
    for i := 1 to miv_length do
        ch := pri [i]
        to := 0
        vo := 0
        for j := 1 to cla_width do
                vo := vo + cla [i, j]
            to := to + cla [i,j] * Vcc [cla_name[j]]
        end for
        to := to + (miv [i] – vo) * Vcc [cla_name[0]]
        if to <= max_capacity then
                mute[ch] := FALSE
        end if
    end for
end if
```

What is claimed is:

1. A method by which a programmable device (10), used for producing music based on a digital music file indicating instructions for producing music on different channels, determines which if any channels to mute depending on available resources, the method characterized by:

a step (61), responsive to channel masking data associated with the digital music file and indicating at least one channel masking in different categories for at least one channel, of providing for each category of the channel a complexity-adjusted number of voices based on a relative resource consumption required by the programmable device (10) when producing voices in the category; and a step (62), responsive to the complexity-adjusted numbers of voices for respective categories for the channel masking, of providing a total voice requirement corresponding to the channel masking.

2. A method as in claim 1, wherein the channel masking data indicates masking of at least one channel in terms of a number of voices required to play the music for the channel and partitioned among different categories of music requiring possibly different resources.

3. A method as in claim 2, wherein each complexity-adjusted number of voices is adjusted for complexity by a voice complexity coefficient for the respective category, the complexity coefficients indicating a relative resource consumption required by the programmable device (10) when producing voices in each category.

4. The method of claim 1, wherein the categories include a general musical instrument digital interface (MIDI) category, a Downloadable Sounds level 2 (DLS2) category, a Downloadable Sounds level 1 (DLS1) category, and a sample category for providing audio processing effects.

5. The method of claim 4, characterized in that the audio processing effects include one or more effects indicated by reverb, chorus, flanger, phaser, parametric equalizer, graphical equalizer, or sound according to a three-dimensional sound processing algorithm.

6. The method of claim 1, further characterized by: a step (54), responsive to the total voice requirement, of assessing resources available and selecting channel masking to use in playing the digital music file.

7. A method for a playing digital music file with instructions for producing music arranged on a plurality of channels, wherein the digital music file includes information about resources required for playing music corresponding to the digital music file and is played by a digital music player with predetermined processing capabilities, the method comprising:

organizing the digital music file so that the channels are ranked according to musical importance and assigned a corresponding channel priority;

providing a digital music player having a processing requirement calculation means for calculating the device specific consumption of processing resources based on processing complexity information stored in the device; and having the digital music player play the music use a playback control adjusting means for selecting the playback resources not exceeding the available processing resources of the digital music player, as controlled by the processing requirement calculation means;

the method characterized in that:

the digital music file information is classified into at least one predefined voice category corresponding to a digital music player voice architecture configuration such that the digital music player calculates the processing requirements based on the information in the digital music file and the processing complexity information so as to predict the processing requirements for different voice resources prior to the playback of the digital music file.

8. The method of claim 7, characterized in that the playback resource requirement information contains voice classification information.

9. The method of claim 8, characterized in that the voice classification information defines Downloadable Sounds Level (DLS) voice configurations and audio processing effects.

10. The method of claim 9, characterized in that the audio processing effects include one or more effects indicated by reverb, chorus, flanger, phaser, parametric equalizer, graphical equalizer, or sound according to a three-dimensional sound processing algorithm.

11. The method of claim 7, characterized in that the playback resource requirement information contains Maximum Instantaneous (number of) Voices (MIV) information.

12. The method of claim 7, characterized in that the processing complexity information is a voice complexity coefficient VCC.

13. The method of claim 7, characterized in that the digital music player voice architecture configuration is a Downloadable Sounds Level 1 (DLS1) voice architecture.

14. The method of claim 7, characterized in that the digital music player voice architecture configuration is a Downloadable Sounds Level 2 (DLS2) voice architecture.

15. The method of claim 7, characterized in that the digital music player is a Musical Instrument Digital Interface (MIDI) synthesizer.

16. The method of claim 7, characterized in that the digital music file is an XMF file.

17. The method of claim 7, characterized in that the playback control adjusting means uses channel masking for adjusting the processing load.

18. The method of claim 7, characterized in that a playback resource adjustment decision is made prior to the playback of the digital music file.

19. The method of claim 7, characterized in that the digital music player voice architecture configuration can be adjusted dynamically during the playback.

20. The method of claim 7, characterized in that the digital music player voice architecture can represent multiple different voice configurations in parallel for the playback of one digital music file.

21. A method for playing a digital music file with instructions for producing music arranged on a plurality of channels, wherein the digital music file includes information about resources required for playing music corresponding to the digital music file and is played by a digital music player with predetermined processing capabilities, the method comprising:

organizing the digital music file so that the channels are ranked according to musical importance and assigned a corresponding channel priority;

providing a digital music player having a processing requirement calculation means for calculating the device specific consumption of processing resources based on processing complexity information stored in the device; and having the digital music player play the music use a playback control adjusting means for selecting the playback resources of the device controlled by processing requirement calculation means;

the method characterized in that:

the digital music file information contains playback resource requirement information classified into at least one category corresponding to a digital music player configuration with known processing requirements, and device specific information is utilized by the processing requirement calculation means (CC) to ensure that the digital music player is able to play the music corresponding to the digital music file without exceeding the available resources.

22. A method for playing a digital music file with instructions for producing music arranged on a plurality of channels, wherein the digital music file includes information about resources required for playing music corresponding to the digital music file and is played by a digital music player with predetermined processing capabilities, the method comprising:

organizing the digital music file so that the channels are ranked according to musical importance and assigned a corresponding channel priority;

providing a digital music player having a processing requirement calculation means for calculating the device specific consumption of processing resources based on processing complexity information stored in the device; and having the digital music player play the music use a playback control adjusting means for selecting the playback resources not exceeding the available processing resources of the digital music player, as controlled by the processing requirement calculation means;

the method characterized in that: the digital music player supports device resource management for multiple processing configurations by calculating the total processing requirements based on content dependent processing requirement information and device specific processing complexity information.

23. An apparatus (10) of use in producing music based on a digital music file indicating instructions for producing music on different channels, the apparatus (10) including means for determining which if any channels to mute depending on resources available to the apparatus (10), the apparatus (10) characterized by:

means (61), responsive to channel masking data associated with the digital music file and possibly indicating masking of at least one channel in terms of a number of voices required to play the music for the channel and partitioned among different categories of music requiring possibly different resources, for providing a complexity-adjusted number of voices for each category indicated by the channel masking data for each channel, each complexity-adjusted number of voices adjusted for complexity based on relative resource consumption required by the programmable device (10) when producing voices in each category; and means (62), responsive to the complexity-adjusted numbers of voices for respective categories for each channel masking, for providing a total voice requirement corresponding to each channel masking.

24. The apparatus (10) of claim 23, wherein the categories include a general musical instrument digital interface (MIDI) category, a Downloadable Sounds level 2 (DLS2) category, and a Downloadable Sounds level 1 (DLS1) category.

25. The apparatus (10) of claim 23, further characterized by: means (54), responsive to the total voice requirement, for assessing resources available and selecting channel masking to use in playing the digital music file.

* * * * *